United States Patent [19]

Going, III

[11] 4,241,799

[45] Dec. 30, 1980

[54] PROTECTED CUTTER MOUNTING FOR DRILL BITS

[75] Inventor: Walter S. Going, III, Houston, Tex.

[73] Assignee: Hughes Tool Company, Houston, Tex.

[21] Appl. No.: 85,666

[22] Filed: Oct. 17, 1979

[51] Int. Cl.[3] ..... E21B 10/10; E21B 10/20; E21B 10/52

[52] U.S. Cl. ..... 175/361; 175/53; 175/374

[58] Field of Search ..... 175/361-364, 175/346, 347, 357, 53

[56] References Cited

U.S. PATENT DOCUMENTS

| | | | |
|---|---|---|---|
| 2,215,264 | 9/1940 | Fisher | 175/361 X |
| 2,325,459 | 7/1943 | Zublin | 175/361 X |
| 3,747,999 | 7/1973 | Justman | 175/364 X |
| 3,750,772 | 8/1973 | Venter | 175/364 |
| 3,921,734 | 11/1975 | Goodfellow | 175/364 |
| 4,089,382 | 5/1978 | Pessier | 175/361 |

*Primary Examiner*—Stephen J. Novosad
*Attorney, Agent, or Firm*—Robert A. Felsman

[57] ABSTRACT

A large diameter earth boring drill bit has a cutter mounting system that protects the cutter mounts from formation damage. The drill bit is of the type having a cutter support plate adapted to be secured to a string of drill pipe. A cutter shell is rotatably mounted on a bearing carrier and supported by a cutter mount that is secured to the cutter support plate. The cutter mount has two legs spaced apart, each leg having a slot for receiving a lug that extends from each end of the bearing carrier. The legs and lugs have apertures, with a wedge connector for insertion through for connecting the bearing carrier to the cutter mount. A protector member extends from at least one end of the bearing carrier, with the lug extending from the protector member into the slot. The protector member has a surface on each side of the lug that extends over and protects the end of the leg on each side of the slot from formation damage.

3 Claims, 3 Drawing Figures

PROTECTED CUTTER MOUNTING FOR DRILL BITS

BACKGROUND OF THE INVENTION

1. Field of the Invention

This invention relates in general to earth boring drill bits, and in particular to an improved cutter mounting for a large diameter shaft bit.

2. Description of the Prior Art

In U.S. Pat. No. 4,089,382 issued to Pessier, a cutter mounting system is disclosed for mounting cutters on a large diameter drill bit. The drill bit has a cutter support plate secured to a string of drill pipe. A number of cutter assemblies are mounted to the cutter support plate for engaging the earth face. Shafts can be drilled downward, or reamed upward by pulling the bit through a pilot hole, as shown in the drawing.

Each cutter assembly includes a cutter mount secured to the cutter support plate. The cutter mount is generally U-shaped, with a pair of legs spaced radially apart and facing away from the cutter support plate. A vertical slot is formed on each end of each leg. A cutter shell with cutting implememts on its exterior is rotatably mounted on a bearing carrier. The bearing carrier has a lug protruding from each end for engaging a slot in a leg. Each lug and leg have transverse, misaligned, apertures, through which a wedge connector is inserted. The wedge connector expands when tightened, forcing the lug tightly against the bottom of the slot, and securing the bearing carrier to the cutter mount. During drilling, the bearing carrier and cutter shell will be replaced when sufficiently worn. The cutter support plate and the cutter mounts will be reused, with new bearing carriers and cutter shells installed.

During drilling with a cutter mount of this nature, battering of the top of the legs and lugs by the formation have occurred. It is possible for the upper edges of the slot to peen over onto the top of the lug. This would make it difficult for removing the cutter shell and bearing carrier. Also wear on the tops of the leg reduces the life of the cutter mount.

SUMMARY OF THE INVENTION

It is accordingly a general object of this invention to provide an improved cutter mounting system for large diameter bits.

It is a further object of this invention to provide a cutter mounting means for large diameter bits utilizing a wedge connection, in which the tops of the bearing carrier lugs and cutter mount legs are protected from damage by the earth formation.

In accordance with these objects, a cutter mounting means is provided with a protector member formed on the bearing carrier above and integral with the lug. The protector member is wedge-shaped, and extends from the side of the bearing carrier to the edge of the lug. The protector member has two downwardly facing load bearing surfaces that extend laterally on each side of the lug. These surfaces mate and bear against the top surfaces of the leg, on each side of the slot. The slot is cut deeper than the height of the lug, causing forces on the cutter shell to be transmitted through the protector member load bearing surfaces to the cutter mount. The overhanging surfaces of the protector member cover the lug and the top surfaces of the leg to prevent formation damage.

DESCRIPTION OF THE PREFERRED EMBODIMENT

Figure 1:
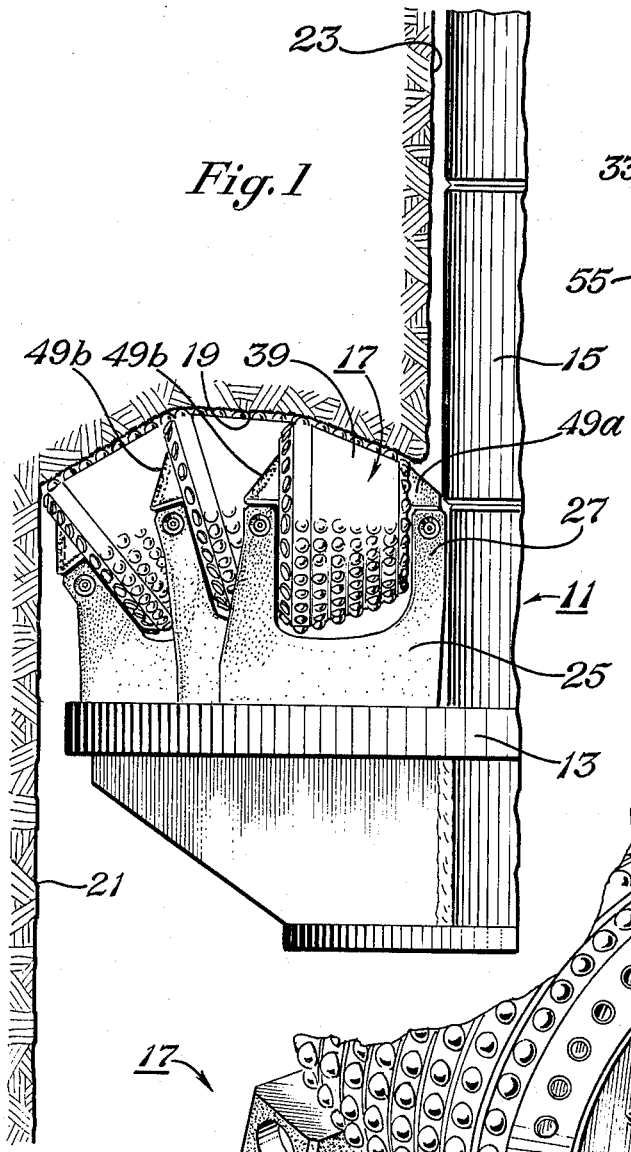
FIG. 1 is a partially sectioned, side elevational view of a drill bit reamer constructed in accordance with this invention.

Referring to FIG. 1, a drill bit, in this case a shaft reamer 11, is shown. Reamer 11 includes a body having a cutter support plate 13 with a stem 15 for connection to a string of drill pipe. Stem 15 is centered on the axis of rotation of the cutter support plate 13 and is normal to the plane of the cutter support plate. A plurality of cutter assemblies 17 are mounted to the cutter support plate 13 at various distances from the stem 15 for disintegrating the formation faces 19 to create a shaft 21. The reamer is shown being pulled upwardly through a previously drilled pilot hole 23, creating shaft 21.

Figure 2:
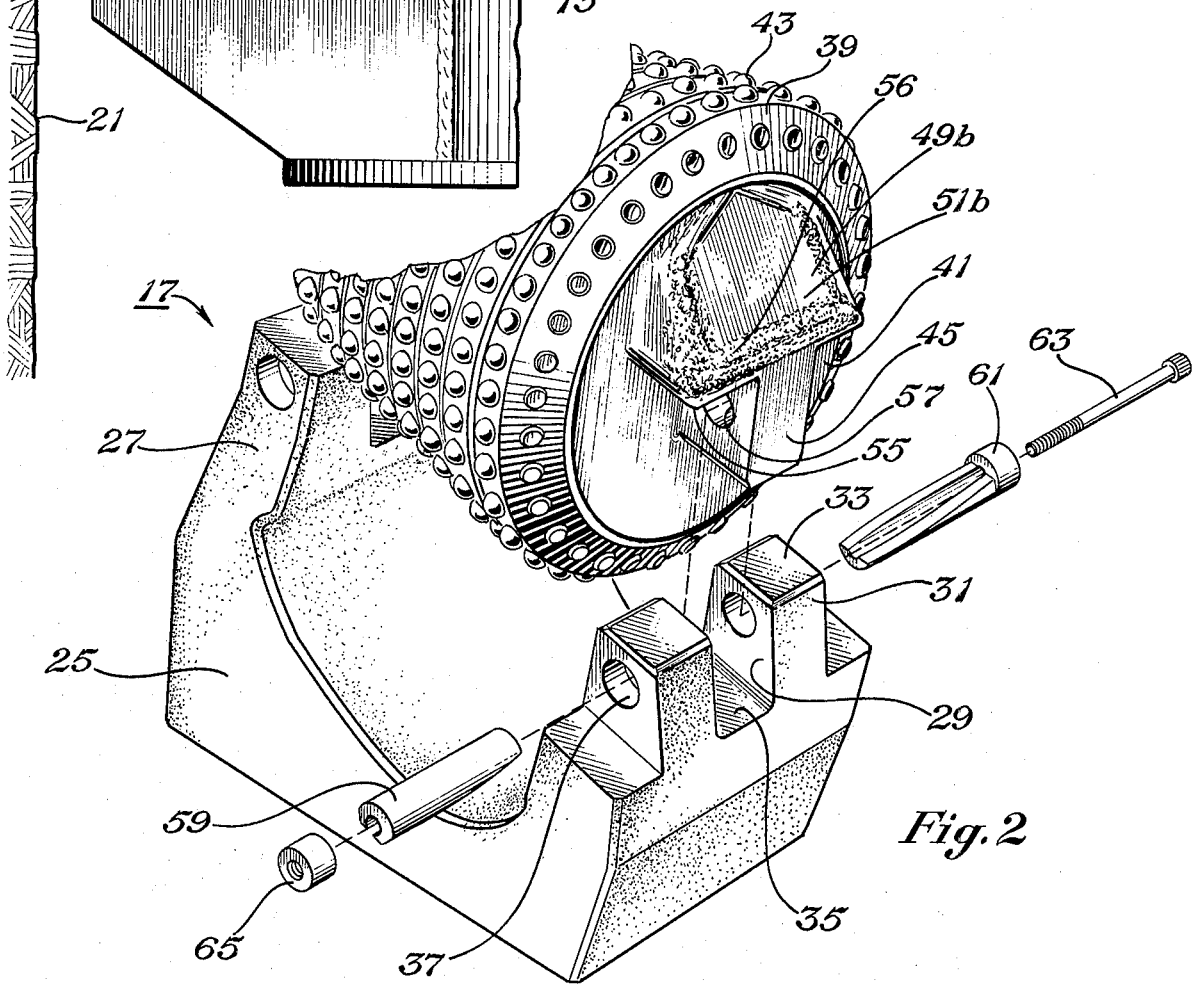
FIG. 2 is an exploded, partial perspective view of one of the cutter assemblies of FIG. 1.

Referring also to FIG. 2, each cutter assembly 17 includes a cutter saddle mount 25 secured to the cutter support plate 13, normally by welding. Cutter mount member 25 is generally U-shaped, with two legs 27 that extend away from the cutter support plate 13. The legs 27 are spaced apart along a radial line emanating from the axis of rotation of the cutter support plate 13. One leg 27 is on the outer side of the cutter assembly 17, and the other on the inner side. Each leg has a vertically extending slot 29 cut through it, defining two lugs 31 on the free ends of each leg 27. A flat, generally rectangular surface 33 about the width of slot 29 and transverse to leg 27, is formed on each lug 31. Slot 29 has a flat base 35 cut to a selected depth. Each lug 31 has a hole 37 of identical size passing transversely through it. The axes of the holes 37 coincide each other and define a common line that is transverse, preferably perpendicular, to a radial line emanating from cutter support plate 13 axis of rotation.

A cutter shell or sleeve 39 is rotatably mounted by bearings on an axle or bearing carrier member 41. The exterior of cutter shell 39 is frusto-conical, with the smaller end being located on the inner side of the cutter assembly 17. Cutter shell 39 has a plurality of cutting implements, which in the drawing comprise rows of sintered tungsten carbide inserts 43, interferingly secured in mating holes in the cutter shell exterior.

Figure 3:
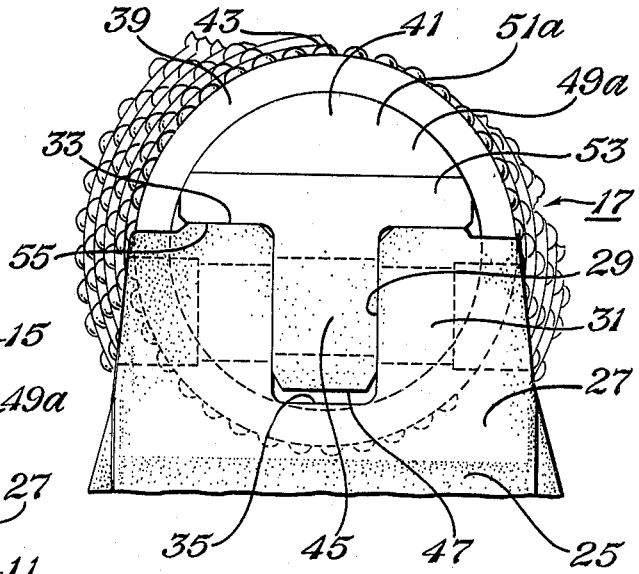
FIG. 3 is a veiw of one of the cutter assemblies of FIG. 1, as seen from the inner end.

Each end of the bearing carrier 41 protrudes past an edge of cutter shell 39, terminating in a lug and protector member combination. Lug 45 is inwardly formed with the bearing carrier 41. Lug 45 is generally rectangular with a transverse direction width approximately equal to the width of slot 29, and a radial direction thickness approximately equal to the thickness of the lugs 31. The vertical height of lug 45 is less than the depth of slot 29, leaving a clearance 47 between the bottom of lug 45 and the bottom 35 of slot 29, as shown in FIG. 3.

Protector members **49*a* and 49*b* are integrally formed on the inner and outer ends, respectively, of bearing carrier 41. Protector members 49*a* and 49*b* are wedge-shaped when viewed from the side, as shown in FIG. 1. Protector members 49*a* and 49*b* each have an inclined surface 51*a* and 51*b*, respectively, that commences near the top of the bearing carrier 41 and terminates equal to that of lug 45. The maximum thickness on the outer end protector member 49***b* occurs at its junction with lug 45, with its inclined surface 51*b* being approximately 60° degrees with respect to the axis of rotation of cutter shell 39. The maximum thickness of the inner end protector member 49*a* occurs approximately midway from the top of the bearing carrier 41 to the commencement of lug 45, defining a vertical portion 53 perpendicular to the cutter shell 39 axis of rotation. The angle of inclination of the inclined portion 51*a* is approximately 35° degrees with respect to the cutter shell 39 axis of rotation.

Each protector member 49*a* and 49*b* is approximately three times the transverse width of lug 45. Lug 45 extends downwardly from the protector member, defining an overhanging, downwardly facing load bearing surface 55 on each side. Each surface 55 is flat, rectangular, and approximately the same dimension as the top surface 33 of lugs 31 on legs 27. Preferably, the protector member surfaces are essentially parallel with the axis of rotation of cutter shell 39 and bear against the top surfaces 33 for transmitting the forces imposed on cutter shell 39 to the cutter mount 25. The edges of the protector member surfaces 55 are substantially flush with the edges of the top surfaces 33. Hardfacing, indicated by numeral 56, is placed on the edges of inclined surfaces 51*a* and 51*b*, to minimize wear on the protector members 49*a* and 49*b*. Preferably the hardfacing consists of tungsten carbide granules in an alloy steel matrix.

A transverse hole 57 is formed in lug 45 in slight misalignment with holes 37, when the bearing carrier 41 is placed on the cutter mount 25. The precise positioning of the holes 57 and 37 is taught in U.S. Pat. No. 4,089,382, all of which material is hereby incorporated by reference into this application. As disclosed therein, hole 57 is slightly farther from the cutter support plate 13, and slightly closer to stem 15, than the holes 37, when the bearing carrier 41 is in position. A wedge or connection means for tending to draw the holes 57 and 37 into alignment with each other, and thereby securing the bearing carrier 41 to the cutter mount 25, is also of the type shown in U.S. Pat. No. 4,089,382. The wedge means is adapted for insertion into holes 37 and 57, and includes tapered wedge members 59 and 61. The wedge members 59 and 61 are drawn toward each other and secured by a bolt 63 and nut 65.

To assemble the cutter assembly 17, cutter shell 39 is assembly with bearings (not shown) bearing carrier 41. The bearing carrier 41 is then placed on the cutter mount 25, with the bearing carrier lugs 45 inserted into slots 29 between the cutter mount lugs 31. Protector member surfaces 55 will bear against the top surfaces 33 of lugs 31. Wedge member 59 is inserted from one end, and wedge member 61 from the other end. Bolt 63 is inserted through the holes provided in the wedge members and tightened to nut 65. The inclined surfaces of the wedge member 59, 61 slide on each other and expand, urging the surfaces 55 and 33 toward each other.

In operation, the cutter support plate 13 is rotated about stem 15. Each cutter shell 39 rotates about its own axis, defining an annular path as the inserts 43 disintegrate the formation face 19. The protector members 51*a* and 51*b* protect the lugs 45 and 31 from damage by the formation. When the cutter is sufficiently worn, the bearing carrier 41 and cutter shell 39 are removed from the cutter mount 25. A new cutter shell 39, with its bearing cutter 41, is mounted to the cutter mount 25 in the same manner as above.

It should be apparent that an invention having significant advantages has been provided. The protector member prevents damage to the top surfaces of the legs and the the lugs on the bearing carrier, that might otherwise make it difficult for the cutter to be removed from the cutter mount. The protector members should increase the life of the cutter mount by avoiding formation damage.

While the invention has been shown in only one of its forms, it should be apparent to those skilled in the art that it is not so limited, but is susceptible to various changes and modifications without departing from the spirit thereof. For example, the cutter assemblies are shown on a raise drill reamer, but could also be mounted on a blind shaft drill bit. In that case, the legs of the cutter assemblies will be substantially as shown, but inverted. Also, in the preferred embodiment, the bearing carrier lug fits between a slot in the leg. It is possible to provide a slot in the bearing carrier, with the leg having a single lug.

I claim:

1. An improved cutter mounting apparatus for an earth boring drill bit, comprising in combination:

a cutter mount having spaced-apart inner and outer end;

a bearing carrier having inner and outer ends for mounting on the ends of the cutter mount;

a cutter shell rotatably mounted on the bearing carrier member;

a selected one of the cutter mount and bearing carrier having a slot through each of its end for receiving the end of the other in the slot;

the ends of the cutter mount and bearing carrier having transverse holes therethrough;

connection means for insertion through the holes to secure the cutter mount to the bearing carrier; and a protector member extending from at least one end of the bearing carrier and having a surface covering an opposing surface of the ends to protect them from formation damage.

2. An improved cutter mounting apparatus for an earth boring drill bit, comprising in combination;

A cutter mount having inner and outer spaced-apart ends, each end being a leg with a vertical slot;

a bearing carrier having inner and outer ends, each end having a lug for reception in one of the slots;

a cutter shell rotatably mounted on the bearing carrier;

the legs and lugs having transverse apertures spaced slightly out of alignment;

wedge means for insertion in the apertures, for tending to draw the aperture in each lug into alignment with the apertures in each leg to connect the bearing carrier to the cutter mount; and a protector member extending from at least one end of the bearing carrier, with the lug extending from the protector member, the protector member having a surface on each side of the lug that bears against an opposing surface on the leg on each side of the slot, the lug being of less height than the slot, causing the wedge means to draw said surfaces of the protector member into tight contact with said surfaces on the leg.

3. In an earth boring drill bit of the type having a cutter support plate adapted to be secured to a string of drill pipe, at least one cutter shell rotatably mounted on a bearing carrier and supported by a cutter mount secured to the cutter support plate, the cutter mount being generally U-shaped with inner and outer ends spaced apart, each end being a leg with a vertical slot therethrough for receiving a rectangular lug extending from each end of the bearing carrier, the legs and lugs having transverse apertures, and wedge means for insertion into the apertures for tending to draw the aperture of the lug into alignment with the apertures of the leg in order to secure the bearing carrier to the cutter mount, the improvement comprising:

a protector member extending from each end of the bearing carrier, the protector member having a generally wedge-shaped configuration tapering outwardly from the outer edge of the bearing carrier to a maximum thickness that is the same thickness as the lug, the protector member being of greater width than the lug, which is positioned between the sides of the protector member and extends from it, the protector member having two generally rectangular surfaces, one on each side of the lug, that mate with two opposing surfaces formed on each leg, one on each side of the slot, said surfaces on the leg being substantially the same dimension as said surfaces on the protector member, the lugs being of less height than the depth of the slot, causing the wedge means to draw said surfaces of the protector member tightly against said surfaces of the leg.

* * * * *